US008387708B2

(12) United States Patent
Anderson et al.

(10) Patent No.: US 8,387,708 B2
(45) Date of Patent: Mar. 5, 2013

(54) PACKOFF WITH INTERNAL LOCKDOWN MECHANISM

(75) Inventors: David A. Anderson, Montrose (GB); James Sinnott, Renfrewshire (GB)

(73) Assignee: Vetco Gray Inc., Houston, TX (US)

( * ) Notice: Subject to any disclaimer, the term of this patent is extended or adjusted under 35 U.S.C. 154(b) by 309 days.

(21) Appl. No.: 12/858,952

(22) Filed: Aug. 18, 2010

(65) Prior Publication Data

US 2012/0043094 A1 Feb. 23, 2012

(51) Int. Cl.
*E21B 23/00* (2006.01)

(52) U.S. Cl. ..... 166/382; 166/217

(58) Field of Classification Search ..... 166/382, 166/208, 217

See application file for complete search history.

(56) References Cited

U.S. PATENT DOCUMENTS 4,714,111 A 12/1987 Brammer
4,719,971 A 1/1988 Owens
4,722,391 A 2/1988 Brammer
4,790,572 A 12/1988 Slyker
4,842,061 A 6/1989 Nobileau
5,638,903 A 6/1997 Kent
7,134,490 B2 * 11/2006 Nguyen ..... 166/208
2011/0036595 A1 * 2/2011 Allen ..... 166/382

OTHER PUBLICATIONS

Search Report from corresponding GB Application No. GB1114042.3 dated Nov. 11, 2011.
Drawing A65126-1, dated Jun. 1, 1994.
ABB Vetco Gray Brochure—"Project Related Procedure 5022", dated Nov. 2000.

* cited by examiner

*Primary Examiner* — William P Neuder
(74) *Attorney, Agent, or Firm* — Bracewell & Giuliani LLP

(57) ABSTRACT

A packoff is located within a wellhead housing and a casing hanger. The packoff has an internal ratchet ring that engages a threaded profile on the exterior of the casing hanger thereby allowing installation of the packoff to be achieved by simply stabbing the packoff over the protruding neck of the casing hanger. This ratchet ring significantly reduces the rotation required during installation, decreasing potential for damage to seals. The casing hanger has an external lock ring that is inwardly biased. During installation of the packoff, the packoff acts to activate the lock ring to thereby force it outward. The lock ring is forced outward and into a recess formed in the interior of the wellhead housing. The lock ring and the ratchet ring locks the packoff and casing hanger into place with the wellhead housing without the need of external lockdown screws, thereby minimizing leak paths.

18 Claims, 5 Drawing Sheets

PACKOFF WITH INTERNAL LOCKDOWN MECHANISM

FIELD OF THE INVENTION

The invention relates in general to an improved wellhead seal, and in particular to an improved casing packoff in a surface wellhead.

BACKGROUND OF THE INVENTION

Casing hangers are typically used in well operations to support casing string that extends down into the well. The casing is typically nested within the well as a plurality of casing strings, with decreasing diameters, which are introduced into the well and hung from corresponding hangers. The casing hanger may be landed within the wellhead housing, allowing the load to be transferred to the wellhead housing. An internal locking mechanism is used to maintain the casing hanger in place.

A packoff is typically utilized in wellheads to form a seal between the wellhead housing and the casing hanger. The packoff comprises a generally cylindrical body and elastomer seals on both outer and inner surfaces to effect the seal. Once in place, external lockdown screws may be used to lock the packoff in place. Unfortunately, the external lockdown screws penetrate the wellhead housing to lock the packoff in place, creating additional leak paths. In addition, existing internal lockdown arrangements which attempt to replace the external lockdown screws require the seal elements to be rotated during locking of the packoff, increasing the potential for damage to the elastomeric seals. A technique for locking the packoff in place while reducing leak paths is desired.

SUMMARY OF THE INVENTION

In an embodiment of the invention, a packoff is located within a wellhead housing and a casing hanger. Casing may be nested within the well as a plurality of casing strings, with decreasing diameters, are introduced into the well and hung from corresponding hangers. The casing hanger in this embodiment may be a mandrel-type casing hanger that is landed within the wellhead housing, allowing the casing load to be transferred to the wellhead housing.

The packoff comprises a generally cylindrical body and elastomer seals on both outer and inner surfaces to effect the seal. The packoff may have an internal ratchet ring located within a recess formed on the inner profile of the packoff. The internal ratchet ring allows for engagement of a threaded profile on the exterior of the casing hanger. Further, the casing hanger has an external lock ring located near its bottom end that is inwardly biased and is received initially within a recess formed on the exterior profile of the packoff. During installation of the packoff, a lower end of the packoff acts to activate the lock ring to thereby force it outward. The lock ring is forced outward and into a recess formed in the interior of the wellhead housing.

This locking mechanism advantageously locks the packoff into place with the wellhead housing without the need of external lockdown screws, thereby minimizing leak paths, and decreasing the number of parts. Further, the packoff design eliminates the need for rotating the sealing elements because there is not orientation requirement in the new design.

DETAILED DESCRIPTION OF THE INVENTION

Figure 1:
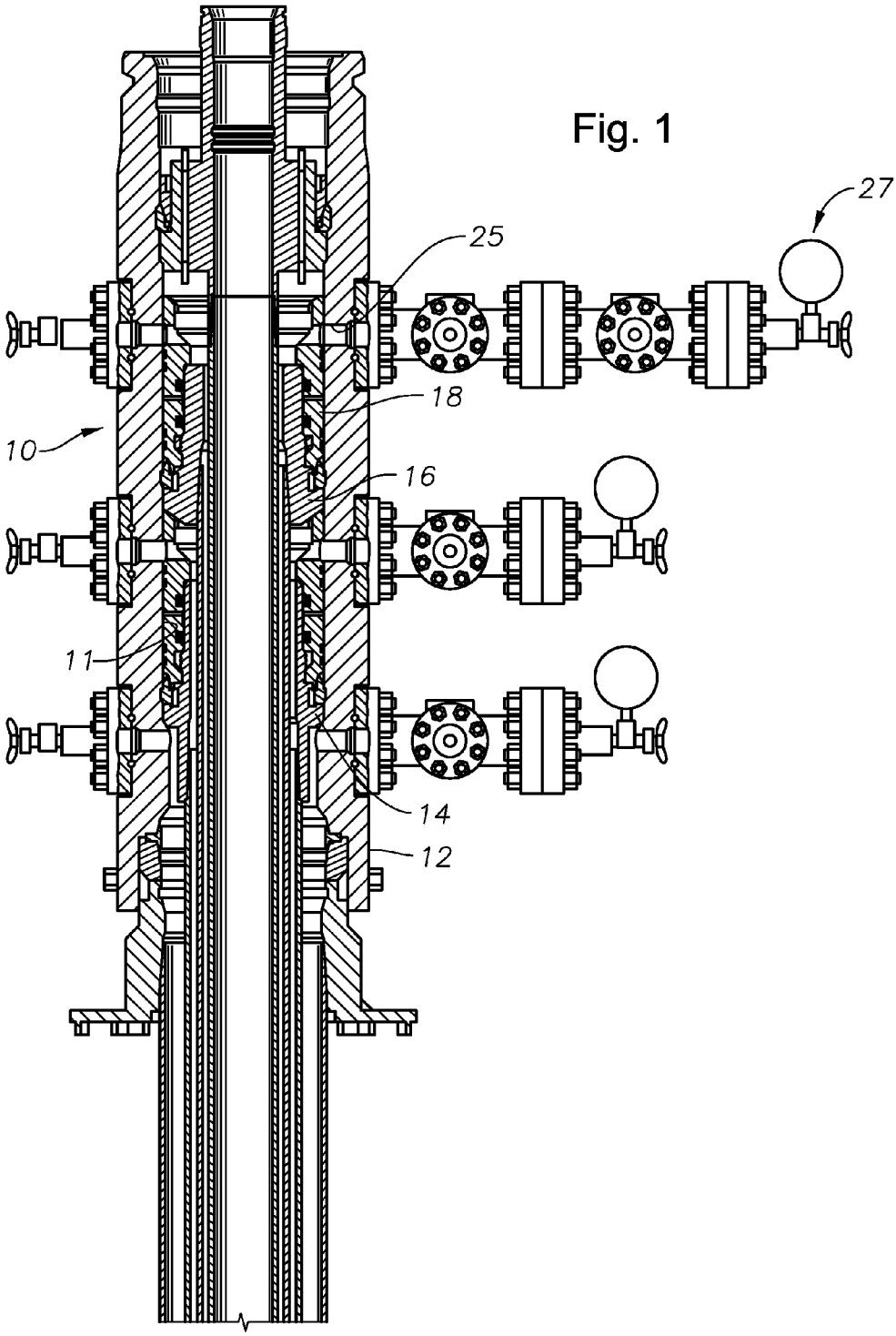
FIG. 1 is a sectional view illustrating a wellhead including casing, casing hangers, and a packoff, in accordance with one embodiment of the invention.

FIG. 1 shows an embodiment of a surface wellhead assembly 10 used in well operations. The wellhead assembly 10 has a wellhead housing 12 with a bore 11 and, in this example, internally accommodates a plurality of casing hangers. In this example, a lower casing hanger 14 is located within a lower end of the wellhead housing 12 and supports a string of casing that extends into the well. In this example, a mandrel-type casing hanger 16 is located above the lower hanger 14 and supports a string of casing that extends down into the well concentrically within previously installed casing strings. However, other types of casing hangers may also be employed. A packoff 18 is installed in the annular space between the casing hanger 16 and the wellhead housing 12. The packoff 18 provides a seal between the casing hanger 16 and the wellhead housing 12.

Figure 2:
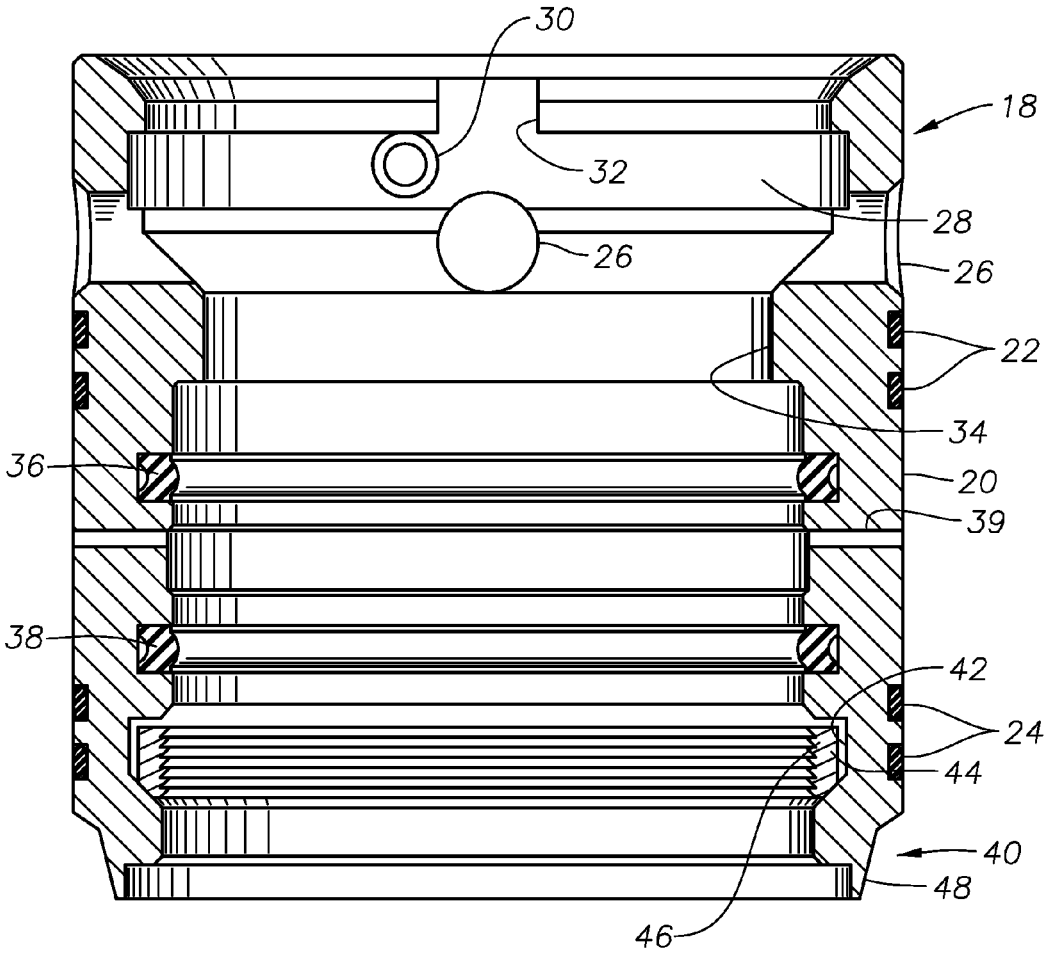
FIG. 2 is a section view showing the packoff, in accordance with one embodiment of the invention.
Figure 3:
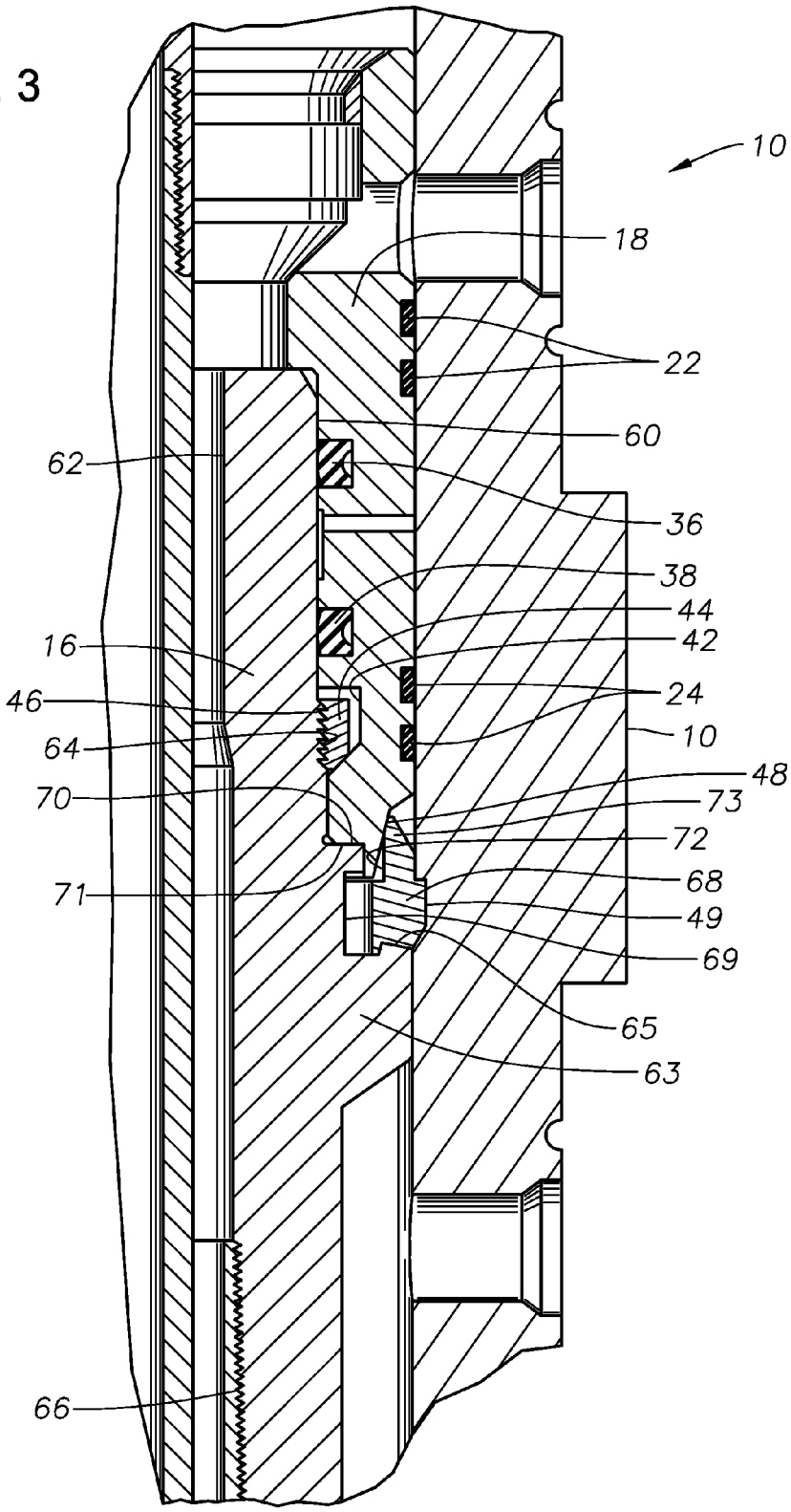
FIG. 3 is section view of an embodiment of the packoff of FIG. 2 installed within a wellhead housing and a mandrel-type casing hanger, in accordance with one embodiment of the invention.

Referring to FIGS. 1 and 2, the packoff 18 is shown enlarged for clarity. The interface between the packoff 18, wellhead housing 12 and casing hanger 16 is shown in FIG. 3. The packoff comprises a generally cylindrical body with an exterior profile 20. Upper and lower elastomeric seals 22, 24 are both shown located on the exterior profile of the packoff 18 and will seal against the bore 11 of the wellhead housing 12. In this example, bypass ports 26 communicate an inner bore 34 of the packoff 18 with the exterior surface 20. The bore 34 of the packoff 18 closely receives the casing hanger 16 during installation. The bypass ports 26 may in turn communicate with ports 25 formed on the wellhead housing 12 used for instrumentation 27 as shown in FIG. 1, for example.

Figure 4:
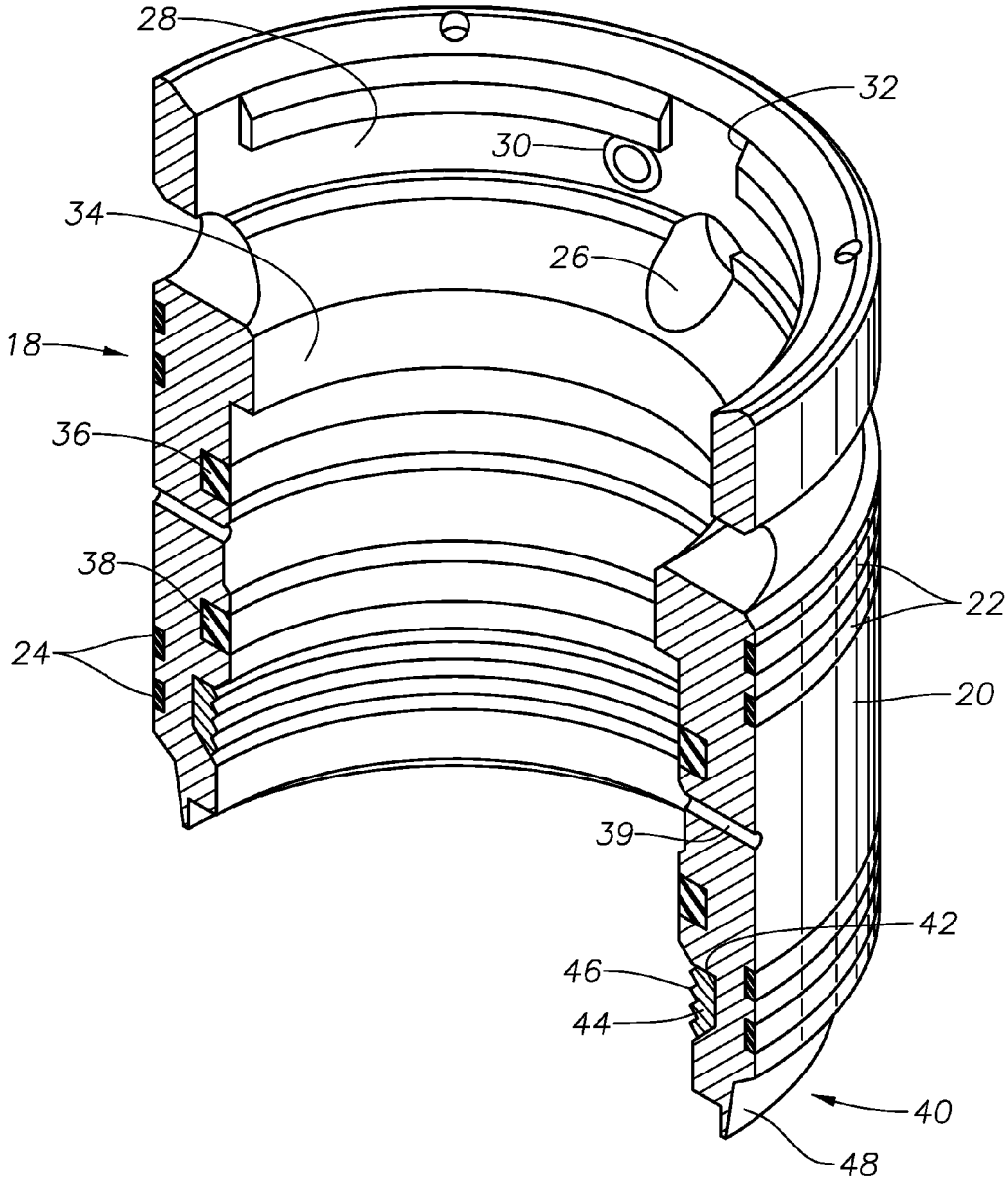
FIG. 4 is perspective section view of an embodiment of the packoff of FIG. 2, in accordance with one embodiment of the invention.

Continuing to refer to FIG. 2, the packoff 18 has a cylindrical recess or groove 28 formed in the upper end of the bore 34 of the packoff 18. The recess 28 allows a standard running tool (not shown) to hold the packoff 18 for installation between the wellhead housing 12 and casing hanger 16. A stop 30 formed within the recess 28 protrudes radially inward to provide a rotation stop for the running tool dogs (not shown) to secure engagement of the packoff 18 during installation while a slot 32 allows the dogs to disengage the packoff 18 after a running operation. The features of the packoff 18, including the recess 28 and stop 30 are also shown in a perspective sectional view, FIG. 4, for additional clarity.

Figure 5:
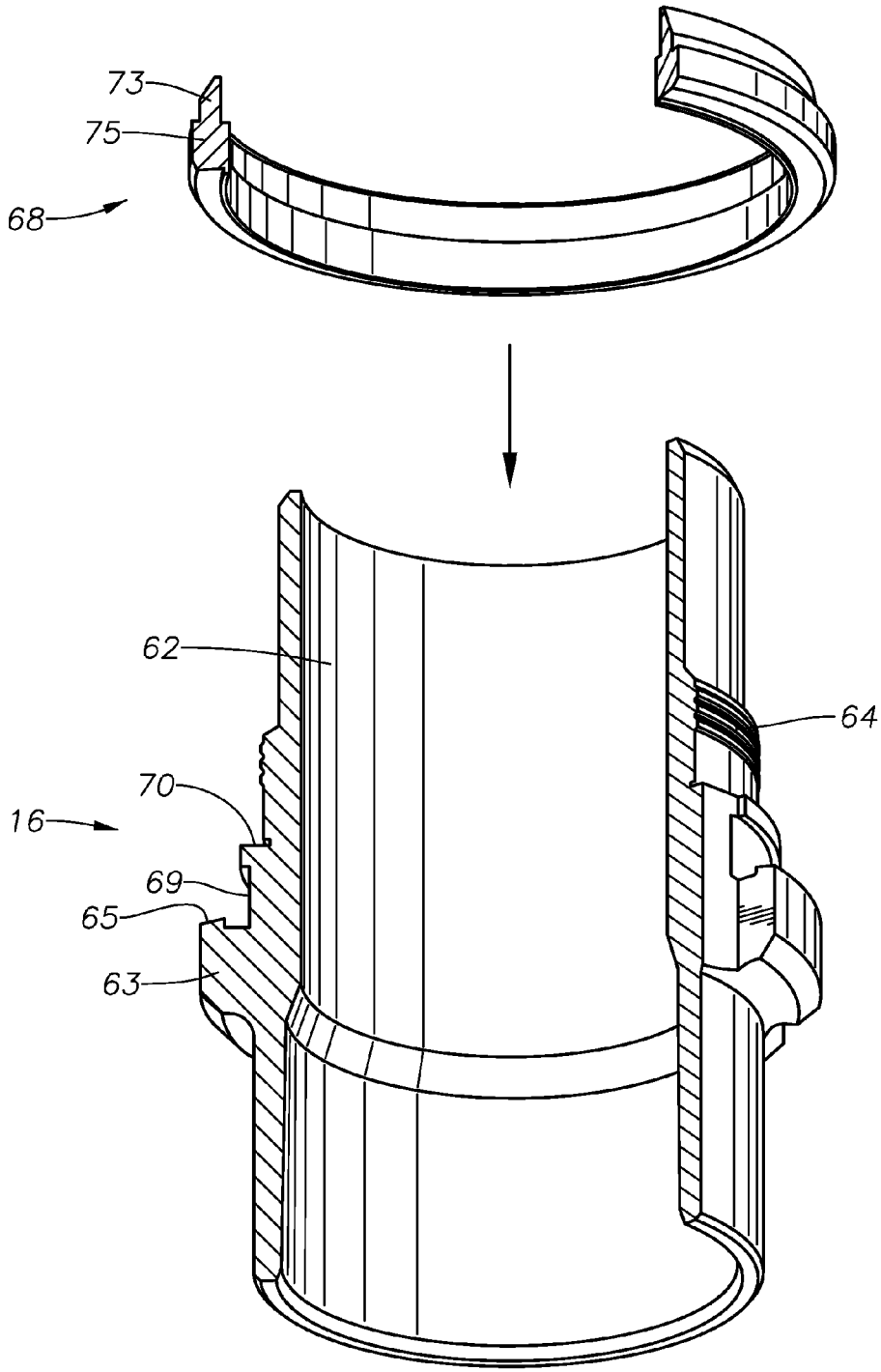
FIG. 5 is a perspective section view of an embodiment of the casing hanger shown in FIG. 3, in accordance with one embodiment of the invention.

The packoff 18 may also have an upper internal elastomeric seal 36 and a lower internal elastomeric seal 38 shown set in grooves formed in the packoff and circumscribing the bore 34. These interior elastomeric seals 36, 38 are located in a portion of the packoff bore 34 that closely receives a portion of the exterior surface of the casing hanger 16 (FIGS. 1 and 3). In this example, a test port 39 that may be used to detect leaks, communicates the packoff bore 34 with the exterior surface 20 of the packoff 18. The test port 39 is axially located on the packoff 18 at a point between the interior elastomeric seals 36, 38 and the external elastomeric seals 22, 24. A recess 40 having a tapered shoulder 48 is formed on the exterior lower end of the packoff 18. The recess 40 and tapered shoulder 48 interface with a recess 49, formed on the interior bore of the wellhead 12, and a lockdown ring 68 (FIG. 3) carried by the casing hanger 16 during installation. This internal mechanism thereby locks the casing hanger 16 to the wellhead 12 without the need of external screws. The lockdown ring 68 may be a spring-type C-lock ring that is inwardly biased and normally retained within a recess 69 (FIG. 3) formed on the exterior profile 60 of the casing hanger 16. The features of the lockdown ring 68 and casing hanger 16 are also shown in a perspective sectional view, FIG. 5, for additional clarity.

Referring to FIG. 3, the packoff 18 is shown installed between the wellhead housing 12 and the casing hanger 16. The casing hanger 16 has an upper internal bore 62 and a lower internal bore 66 that may be in contact with another tubular member such as a tubing hanger. Running teeth 64 are formed on the exterior of the casing hanger 16 that are used when the casing hanger 16 is run down the well. When assembled, the teeth 64 also function to lock the casing hanger 16 to the packoff 18 by stabbing and threadingly engaging with teeth 46 formed on a ratchet ring 44, thereby locking the packoff 18 to the casing hanger 16. Alternatively, a separate set of teeth can be formed on the casing hanger 16 dedicated to just running the casing hanger 16. The ratchet ring 44 is retained within a recess 42 formed on the interior lower portion of the packoff 18.

In an example embodiment, during the running operation, the casing hanger 16 is first run into the well in a conventional manner, with a running tool (not shown) engaging the external teeth 64 (FIG. 3) on the casing hanger 16. The casing hanger 16 is landed on an upward facing shoulder formed on the wellhead housing bore 11 and the running tool is removed. The packoff 18 may be run down the well over the casing hanger 16 on a conventional L-Slot running tool (not shown). The running tool engages the groove 28 (FIGS. 2, 4) in the interior of the packoff 18. The teeth 46 on the packoff ratchet ring 44 stab onto the running teeth 64 on the casing hanger 16 (FIG. 3). This allows the packoff 18 to be inserted linearly into the annulus without rotation, thereby protecting the elastomeric seal elements 22, 24, 36, and 38. Stops 30 within the groove 28 allow the running tool to effect a quarter turn of the packoff 18 that secures the packoff 18 to the casing hanger 16 and provides the necessary sealing. The running tool can then disengage the packoff 18 by rotating the tool until dogs slip out via the slots 32.

Continuing to refer to FIG. 3, the external lockdown ring 68 may be activated when the packoff 18 is stabbed onto the casing hanger 16. As the packoff 18 is forced down, the tapered shoulder 48 on the packoff 18 is forced against the interior portion of rim 73 that projects from the lockdown ring 68. The smaller-to-larger radius of the tapered shoulder 48 contacting the rim 73 forces the lockdown ring 68 outward, creating a pocket 72 and causing the lockdown ring 68 to slide radially out of the recess 69 and along an upward facing shoulder 63 formed on the exterior of the casing hanger 16. The lockdown ring 68 continues sliding outward until a radial protrusion 75 (FIG. 5) formed on the exterior of the lockdown ring 68 is received by the internal recess 49 formed on the wellhead housing 12, thereby locking the casing hanger 16 to the wellhead housing 12. A downward facing shoulder 70 on the packoff 18 comes to rest on an upward facing shoulder 71 on the casing hanger 16 located approximately adjacent to pocket 72. A downward facing profile of the internal recess 49 formed on the wellhead housing 12 demarcates the rim 73 from the rest of the lockdown ring 68.

While the invention has been shown in only a few of its forms, it should be apparent to those skilled in the art that it is not so limited but is susceptible to various changes without departing from the scope of the invention.

The invention claimed is:

1. A surface wellhead apparatus, comprising:

an outer wellhead member having a bore coupled to an upper end of a string of conduit extending into a well;

an inner wellhead member within the bore of the outer wellhead member, the inner wellhead member having a first toothed profile on an outer surface;

an annular packoff configured to be located in an annulus between the inner and outer wellhead members to form a seal therebetween, the annular packoff having a tubular body;

an inner seal on a inner surface of the body that seals against the inner wellhead member;

an outer seal on an outer surface of the body that seals against the outer wellhead member; and an expandable inner retaining ring carried within a groove on the inner surface of the body below the inner seal, the inner retaining ring having a second toothed profile on an inner surface that engages the first toothed profile to lock the body of the packoff to the inner wellhead member, wherein the inner retaining ring ratchets inward and outward as the second toothed profile engages the first toothed profile during the insertion of the body of the packoff into the annulus.

2. The apparatus according to claim 1, further comprising:

an annular recess in the bore of the outer wellhead member; and an expandable outer retaining ring that snaps into locking engagement between the recess and the packoff in response to insertion of the body into the annulus.

3. The apparatus according to claim 1, further comprising:

an annular recess in the bore of the outer wellhead member:

an expandable outer retaining ring carried on the outer surface of the inner wellhead member; and a tapered shoulder depending from the body of the packoff that wedges the outer retaining ring into the recess as the packoff is moved downward relative to the inner wellhead member lock the inner wellhead member and the packoff to the outer wellhead member.

4. The apparatus according to claim 3, further comprising an upward-facing shoulder on the inner wellhead member on which the oputer retaining ring is carried.

5. The apparatus according to claim 1, wherein the inner and the outer seals are elastomeric.

6. The apparatus according to claim 1, wherein the body of the packoff is a single-piece metal member.

7. The apparatus according to claim 1, further comprising a profile formed at an upper end of the body of the packoff for releasable engagement by a running tool to support and stab the body of the packoff into place.

8. The apparatus according to claim 1, wherein:

the inner wellhead member has a smooth cylindrical surface that is engaged by the inner seal; and the first toothed profile is located below the smooth cylindrical surface.

9. The apparatus according to claim 1, wherein:

prior to the insertion into the annulus, the inner seal protrudes radially inward from the inner surface of the body of the packoff so as to seal against the outer surface of the inner wellhead member as the packoff enters the annulus.

10. The apparatus according to claim 1, wherein the outer seal seals against the bore of the outer wellhead member as the packoff enters the annulus.

11. The apparatus according to claim 1, wherein:

the inner seal comprises upper and lower inner seals;

the outer seal comprises upper and lower outer seals; and the apparatus further comprises at least one port extending through the body of the packoff from a point between the upper and lower inner seals to a point between the upper and lower outer seals for communication with an instrumentation device.

12. The apparatus according to claim 11, wherein the inner seal protrudes radially inward from the inner diameter surface of the packoff body as to seal against the exterior of the inner wellhead member as the packoff body enters the seal pocket.

13. An apparatus for sealing between inner and outer wellhead members, comprising:

a packoff body to be positioned in a seal pocket between the outer and inner wellhead members, the packoff body having an inner diameter surface and an outer diameter surface, the inner diameter surface having an annular recess;

a ratchet ring carried within the annular recess, the ratchet ring having a set of teeth for securing to a set of teeth formed on an exterior of the inner wellhead member to secure the packoff body to the inner wellhead member;

an elastomeric inner seal within an inner seal groove in the inner diameter surface of the packoff body above the ratchet ring for sealing to the exterior of the inner wellhead member above the teeth on the exterior of the inner wellhead member; and an elastomertic outer seal within an outer seal groove on the outer diameter surface of the packoff body for sealing to the outer wellhead member.

14. The apparatus according to claim 13, wherein the outer seal is adapted to seal against the outer wellhead member as the packoff body enters the seal pocket.

15. The apparatus according to claim 13, wherein:

the inner seal comprises upper and lower inner seals;

the outer seal comprises upper and lower outer seals; and the apparatus further comprises at least one port extending through the packoff body from a point between the upper and lower inner seals to a point between the upper and lower outer seals for communication with an instrumentation device.

16. A method for installing an inner wellhead member into an outer wellhead member of a well, comprising:

landing the inner wellhead member within a bore of the outer wellhead member, defining an annular seal pocket between the inner wellhead member and the outer wellhead member, the inner wellhead member having a toothed profile located on a portion of an exterior profile;

providing an annular packoff having a tubular body, an elastomeric inner seal on an inner surface of the body, an elastomeric outer seal on an outer surface of the body, and an expandable retaining ring carried within a groove on the inner surface of the body below the inner seal, the retaining ring having a toothed profile on an inner surface; and lowering the body of the packoff into the seal pocket, causing the outer seal to seal against the bore of the outer wellhead member and the inner seal to seal against the exterior profile of the inner wellhead member, and engaging the toothed profile of the expandable ratchet ring with the toothed profile on the exterior profile of the inner wellhead member to secure the packoff to the inner wellhead member.

17. The method of claim 16, wherein the outer seal seals against the bore of outer wellhead member simultaneously with the downward movement of the body of the packoff into the seal pocket.

18. The method of claim 16, wherein providing the packoff comprises causing the inner seal to protrude radially inward from the inner surface of the body so the the inner seal slides down the bore of the outer wellhead member as the body of the packoff enters the seal pocket.

* * * * *

UNITED STATES PATENT AND TRADEMARK OFFICE

CERTIFICATE OF CORRECTION

PATENT NO. : 8,387,708 B2
APPLICATION NO. : 12/858952
DATED : March 5, 2013
INVENTOR(S) : Anderson et al.

It is certified that error appears in the above-identified patent and that said Letters Patent is hereby corrected as shown below:

In the Claims

In Column 4, Line 45, in Claim 4, delete "oputer" and insert -- outer --, therefor.

In Column 6, Line 35, in Claim 18, delete "the the" and insert -- that the --, therefor.

Signed and Sealed this
Sixteenth Day of July, 2013

Teresa Stanek Rea
*Acting Director of the United States Patent and Trademark Office*